US005238062A

United States Patent [19]

Reinholdt

[11] Patent Number: 5,238,062

[45] Date of Patent: Aug. 24, 1993

[54] CENTRALIZER FOR CENTRING DRILLING AND CASING PIPES AND CENTRALIZING ARRANGEMENT INCLUDING SAID CENTRALIZER

[75] Inventor: Bernd Reinholdt, Langenhagen, Fed. Rep. of Germany

[73] Assignee: Weatherford/Lamb, Inc., Houston, Tex.

[21] Appl. No.: 871,642

[22] Filed: Apr. 21, 1992

[30] Foreign Application Priority Data

Apr. 27, 1991 [DE] Fed. Rep. of Germany ..... 4113898

[51] Int. Cl.[5] ..... E21B 17/10

[52] U.S. Cl. ..... 166/241.7

[58] Field of Search ..... 166/241.1-241.7, 166/65.1, 66

[56] References Cited

U.S. PATENT DOCUMENTS

| | | | |
|---|---|---|---|
| 2,387,493 | 10/1945 | Brokaw | 166/241.1 X |
| 2,582,719 | 1/1952 | Ramsey | 166/241.5 X |
| 2,618,342 | 11/1952 | Meyer | 166/241.1 X |
| 2,828,824 | 4/1958 | Comstock | 166/241.7 X |
| 2,898,136 | 8/1959 | Hall, Sr. et al. | 287/52 |
| 2,944,603 | 7/1960 | Baker et al. | 166/241.5 X |
| 2,986,417 | 5/1961 | Baker | 287/52.08 |
| 3,000,444 | 9/1961 | Wright et al. | 166/241 |
| 3,065,005 | 11/1962 | Hall, Sr. et al. | 287/52 |
| 3,072,196 | 1/1963 | Love | 166/241 |
| 3,200,884 | 8/1965 | Solum et al. | 166/241.6 |
| 3,343,608 | 9/1967 | Solum | 166/241 |
| 3,566,965 | 3/1971 | Solum | 166/241 |
| 3,575,239 | 4/1971 | Solum | 166/241 |
| 3,643,739 | 2/1972 | Hall, Sr. | 166/241 |
| 3,889,750 | 6/1975 | Mullins | 166/217 |
| 4,042,022 | 7/1977 | Wills et al. | 166/241 |
| 4,269,269 | 5/1981 | Wilson | 166/241 |
| 4,363,360 | 12/1982 | Richey | 166/241 |
| 4,425,966 | 1/1984 | Garney | 166/241.5 |
| 4,520,869 | 6/1985 | Svenson | 166/241 |
| 4,787,458 | 11/1988 | Langer | 166/380 |
| 4,794,986 | 1/1989 | Langer | 166/241 |

OTHER PUBLICATIONS

U.K. Patent Application No. GB 2,171,436A filed 15 Jan. 86 and naming Mikolajczyk as inventor.

"General Services and Products Catalog 1990-91" Weatherford 1989.

*Primary Examiner*—Ramon S. Britts
*Assistant Examiner*—Frank S. Tsay
*Attorney, Agent, or Firm*—Guy McClung

[57] ABSTRACT

A centralizer comprises two spaced-apart support rings connected by spring bows. Each support ring is provided with an internal groove. In use the centralizer is slid onto a pipe provided with two spaced-apart external grooves. When the internal grooves on the support rings overly the external grooves on the pipe a flexible stop ring is inserted through a window in the support rings into a space defined by the internal groove and the external groove. The internal groove on the support ring extends axially longer than the stop ring by an amount such that the spring bows can be pressed flat against the periphery of the pipe.

6 Claims, 2 Drawing Sheets

CENTRALIZER FOR CENTRING DRILLING AND CASING PIPES AND CENTRALIZING ARRANGEMENT INCLUDING SAID CENTRALIZER

FIELD OF THE INVENTION

This invention relates to a centralizer for centralizing drilling and casing pipes and to a centralizing arrangement including said centralizer.

BACKGROUND OF THE INVENTION

Centralizers are used to maintain drilling pipes substantially centred in a well bore during drilling. They are also used to centre casing in the well bore, for example in preparation for cementing.

Centralizers generally comprise a plurality of outwardly curved spring bows which extend between a top and a bottom support ring. The outwardly curved spring bows offer considerable resistance to the introduction of a pipe provided with the centralizer into a well bore or an enclosing casing pipe. However, whilst the centring force of the centralizer must be high to operate effectively existing standards require that the insertion forces do not exceed a predetermined limit. These demands can be met when there is sufficient space between the external periphery of the pipe to be inserted and the well bore (or enclosing casing pipe). However, if the annular gap is small, for example, only to a few millimetres, it has hitherto been impossible to use satisfactory centring devices.

An attempt was made to obviate these difficulties as disclosed in German Utility Model 89 03 038. In particular, in one embodiment the centralizer can be pressed against the periphery of the pipe due to a clearance for the support rings. However, the centralizer has to be assembled around the pipe. In another embodiment stop rings are welded to the external periphery of the pipe. However, this is technically undesirable and time-consuming.

DISCLOSURE OF THE INVENTION

It is an object of the invention to provide a centralizer which, at least in its preferred embodiments, is simple to manufacture, can readily be mounted on a suitable pipe, and subjects the spring bows essentially to tensile stressing when a pipe equipped therewith is lowered into a well bore.

The present invention provides a centralizer for centralizing drilling and casing pipes, said centralizer comprising:

a) two spaced-apart support rings;

b) a plurality of spring bows extending between said support rings;

c) an internal groove in at least one of said support rings; and d) a window in said support ring to permit insertion of a stop ring into said internal groove.

Preferably, the centralizer includes an internal groove in both said support rings, and d) a window in each support ring to permit insertion of a stop ring into respective ones of said internal grooves.

The present invention also provides a centralizer arrangement comprising:

a) a pipe having an external peripheral groove;

b) a centralizer in accordance with the invention mounted on said pipe; and c) a stop ring extending partially in said external peripheral groove in said pipe and partially in said internal groove in said at least one support ring, said stop ring restricting axial movement of said centralizer relative to said pipe.

Advantageously, in embodiments where the pipe has a single external peripheral groove, the internal groove in said support ring extends an axial distance greater than the axial extent of said external peripheral groove in said pipe to permit said centralizer limited axial movement with respect to said pipe.

Preferably, in embodiments where the pipe has two spaced apart external peripheral grooves, each support ring of the centralizer overlies a respective one of said external peripheral grooves; and a stop ring is associated with each support ring, each stop ring extending partially in a respective one of said external peripheral grooves in said pipe and partially in the internal peripheral groove of the support ring overlying said external peripheral groove, said stop rings restricting axial movement of said centralizer relative to said pipe.

Advantageously, as least one of said internal grooves in said support rings extends an axial distance greater than the axial extent of the external peripheral groove in said pipe underlying said support ring to permit said support ring limited axial movement relative to said pipe.

Preferably, both internal grooves in said support rings extend an axial distance greater than the axial extent of the external peripheral grooves in said pipe underlying said respective support rings to permit said support rings limited axial movement relative to said pipe.

Advantageously, the axial extent of said external peripheral groove is sufficient to allow said spring bows to be pressed flat against the circumference of said pipe.

In certain embodiments the present invention teaches a support ring for mounting on a tubular member, including but not limited to a support ring as part of a centralizer for mounting on pipe or casing, the support ring having a body member thorough which the tubular member is inserted. The support ring has one or more grooves in an internal surface thereof for receiving and holding a stop device, including but not limited to an insertable ring which is flexible for ease of insertion into the groove or grooves. The stop device inhibits relative movement between the support ring and the tubular member. To facilitate insertion of the stop device into a groove, an opening or window can be provided through the body member of the support ring. Relative movement between the pipe or other tubular and the support ring can be further inhibited by providing a groove or grooves on the tubular's exterior surface that corresponds to the groove or grooves on the internal surface of the support ring, so that the stop device is received and held in both grooves.

In preferred embodiments of centralizing arrangements according to the invention, the external peripheral grooves in the pipe are of small cross-section so that the pipe is only weakened to a very small extent. The time taken for mounting a centralizer on a pipe is minimal. When a pipe string equipped with preferred centralizers according to the invention is inserted into a bore of small cross-section, the spring bows of the centralizer are subjected primarily to tensile stress, since the leading support ring in the direction of insertion abuts its associated stop ring and restrains the centralizer from further movement. The opposite support ring is however free to make compensating movements. As a result any upsetting and bulging of the spring bows is avoided, something which might otherwise result in undue friction and a higher insertion force. Latching into caverns in the surrounding rock is also inhibited. The stop rings, in conjunction with the support rings of the centralizer can tolerate extremely high stripping forces.

For a better understanding of the present invention reference will now be made, by way of example, to the accompanying drawings, in which:

BEST MODE FOR CARRYING OUT THE INVENTION

Figure 1:
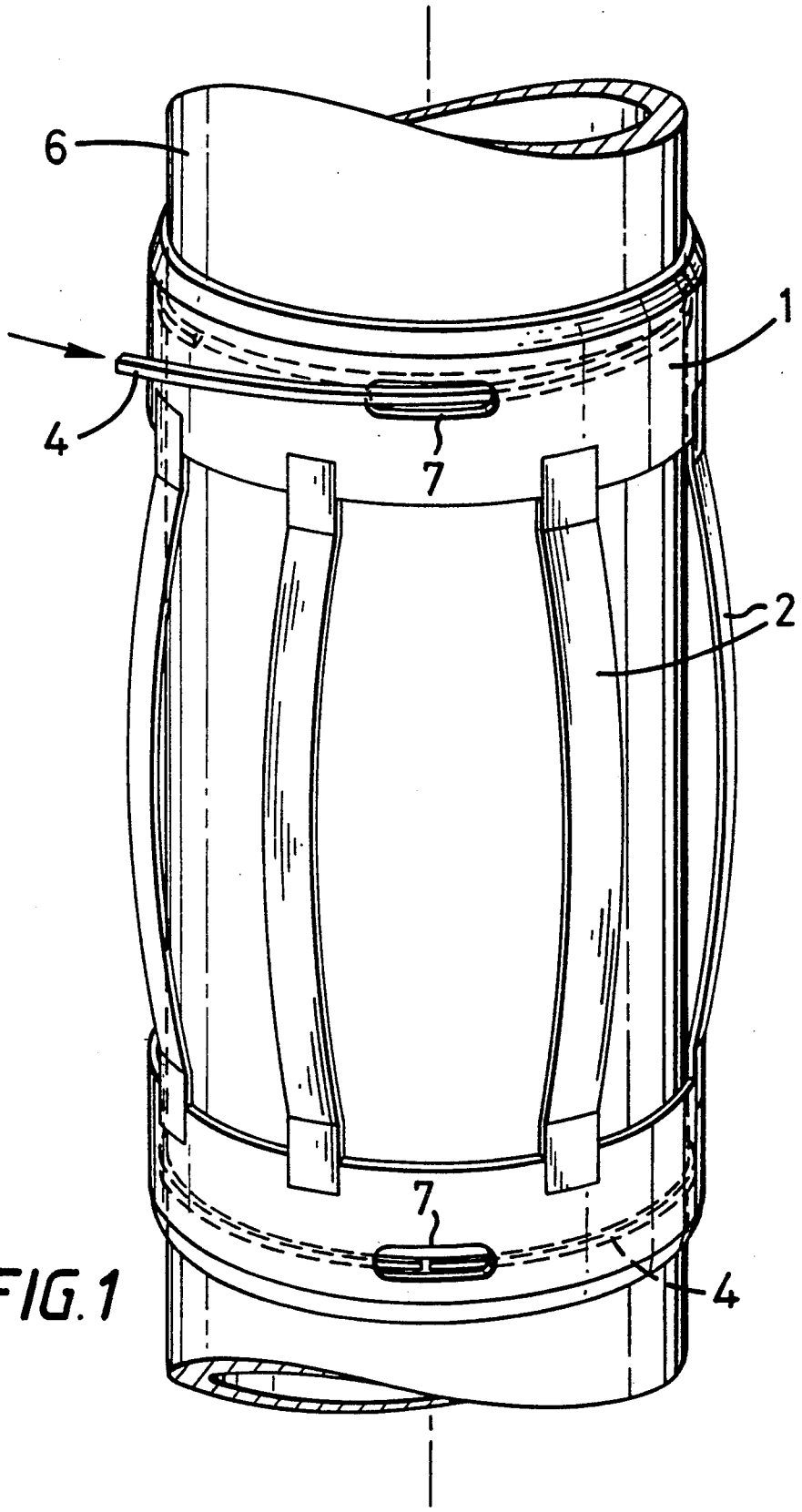
FIG. 1 shows, diagrammatically, a centralizer being mounted on a pipe.
Figure 3:
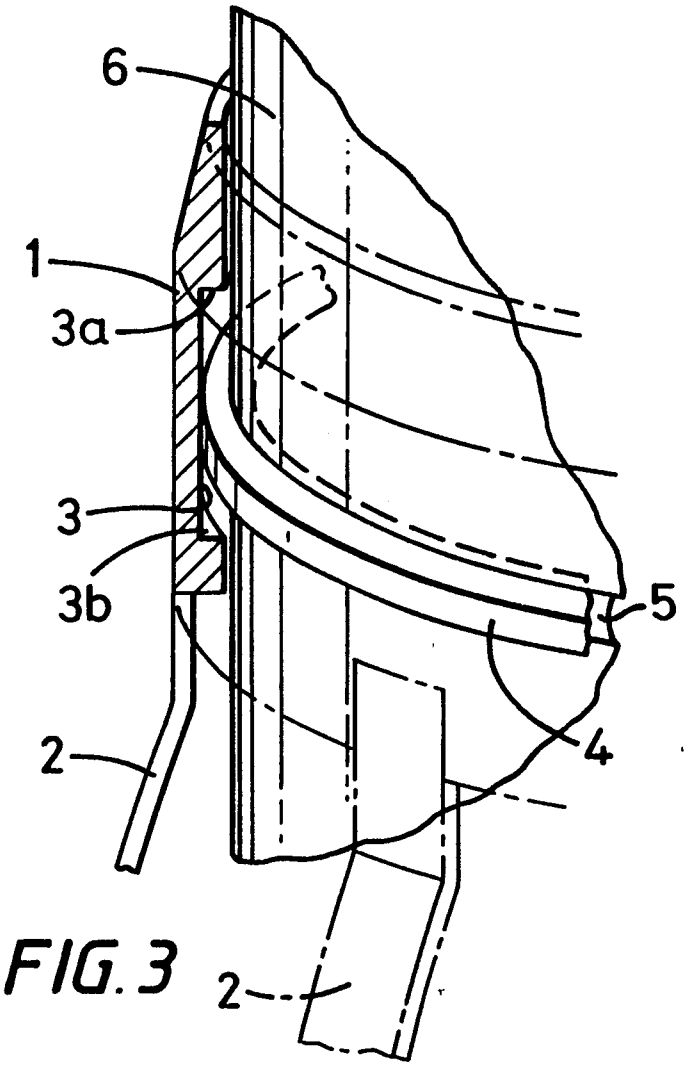
FIG. 3 is a partially sectioned detail to an enlarged scale of the centralizer shown in FIG. 1.
Figure 2:
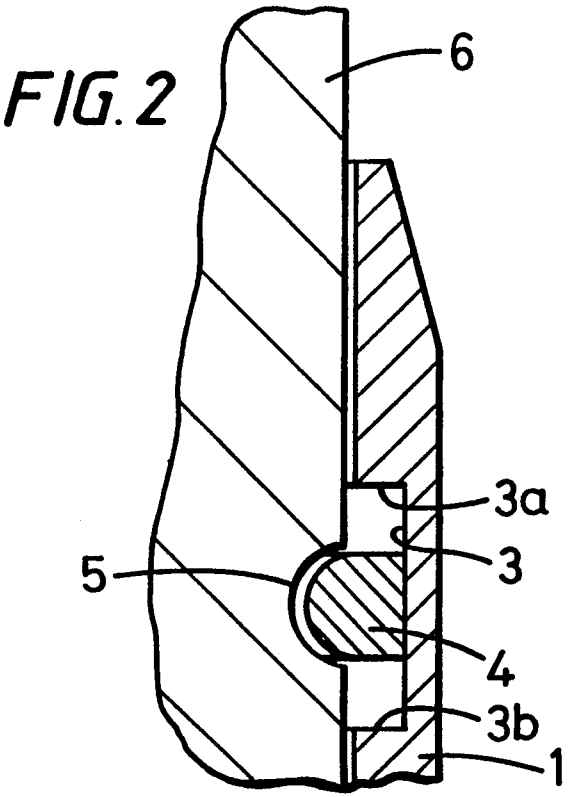
FIG. 2 is a fragmentary section, to an enlarged scale, through one of the support rings of the centralizer.

Referring to FIG. 1, there is shown a centralizer which comprises two support rings I connected by spring bows 2.

Each support ring 1 is formed with an internal groove 3 which accommodates a stop ring 4.

Each stop ring 4 extends partially in internal groove 3 and partially in an external groove 5 in a pipe 6.

Each support ring 1 is formed with at least one window 7 through which the stop ring 4 can be slid into the free space between the internal groove 3 in the support ring 1 and the external groove 5 in the pipe 6 to be centred.

The dimensions provided for the embodiment shown in FIG. 1 are merely exemplary and other dimensions can be substituted.

The assembly procedure for inserting the stop rings 4 is shown particularly clearly in FIG. 1.

When the centralizer has been slid onto the pipe 6 and reached its intended position—i.e., when the external grooves 5 in the pipe 6 are visible through the windows 7 of the support rings 1—the stop rings 4 can be inserted through the windows 7 in the manner illustrated—i.e., substantially tangentially. Due to their flexibility the stop rings 4 are able to enter the space between the internal groove 3 and the external groove 5 and finally seat, as shown in the lower part of FIG. 1. The centralizer is then secured against significant sliding movement relative to the pipe 6. At the same time the support rings 1 allow limited freedom of movement within the axial length of the internal grooves 3.

The axial length of the internal grooves 3 are such that the spring bows 2 can be pressed completely flat against the periphery of the pipe 6. In particular, when a pipe string is inserted into a well bore or into a casing pipe, the side walls 3*a* of the groove 3 of the leading (lower) support ring 1 abut the stop ring 4. The side wall 3*b* of the groove 3 of the trailing (upper) support ring 1 approaches the stop ring 4 without however reaching said stop ring 4. This ensures that the centralizer remains suspended from the leading stop ring 4, while the internal groove 3 in the trailing support ring 1 provides sufficient free space for the spring bows 2 to be completely extended. As a result, solely tensile forces act on the spring bows 2. The risk of distorting the spring bows 2, with undesirable bulging, is obviated.

What is claimed is:

1. A centralizing arrangement comprising
   - a pipe having a pre-existing external peripheral groove,
   - a centralizer mounted on said pipe and comprising two spaced-apart support rings separated by a plurality of spring bows,
   - an internal groove in at least one of said support rings,
   - a stop ring extending partially in said pre-existing external peripheral groove in said pipe and partially in said internal groove in said at least one support ring without digging into the pipe, and
   - a window in said support ring through which said stop ring can be inserted during mounting of said centralizer on said pipe.

2. A centralizing arrangement according to claim 1, wherein said internal groove in said support ring extends an axial distance greater than the axial extent of said external peripheral groove in said pipe to permit said centralizer limited axial movement with respect to said pipe.

3. A centralizer arrangement comprising
   - a pipe having two spaced apart pre-existing external peripheral grooves,
   - a centralizer mounted on said pipe and comprising two spaced-apart support rings separated by a plurality of spring bows, each support ring overlying respective ones of said pre-existing external peripheral grooves in said pipe,
   - an internal groove in each of said support rings, said internal grooves overlying respective ones of said pre-existing external peripheral grooves in said pipe,
   - a stop ring associated with each support ring, each stop ring extending partially in a respective one of said pre-existing external peripheral grooves in said pipe and partially in the internal peripheral groove of the support ring overlying said pre-existing external peripheral groove without embedding of the stop ring in the pipe, and
   - a window in each said support ring through which said stop rings can be inserted during mounting of said centralizer on said pipe.

4. A centralizer arrangement according to claim 3, wherein at least one of said internal grooves in said support rings extends an axial distance greater than the axial extent of the pre-existing external peripheral groove in said pipe underlying said support ring to permit said support ring limited axial movement relative to said pipe.

5. A centralizer arrangement according to claim 3, wherein both internal grooves in said support rings extend an axial distance greater than the axial extent of the pre-existing external peripheral grooves in said pipe underlying said respective support rings to permit said support rings limited axial movement relative to said pipe.

6. A centralizer arrangement according to claim 5, wherein the axial extent of said pre-existing external peripheral grooves is sufficient to allow said spring bows to be pressed flat against the circumference of said pipe.

* * * * *